United States Patent [19]

Clark et al.

[11] 4,345,717

[45] Aug. 24, 1982

[54] LOW PRESSURE FUEL INJECTION SYSTEM

[75] Inventors: Michael W. Clark, Witham; Barrie J. Martin, Shenfield, both of England

[73] Assignee: Plessey Handel und Investments AG, Zug, Switzerland

[21] Appl. No.: 137,419

[22] Filed: Apr. 4, 1980

Related U.S. Application Data

[63] Continuation of Ser. No. 1,859, Jan. 8, 1979, abandoned.

[30] Foreign Application Priority Data

Jan. 17, 1978 [GB] United Kingdom ..... 1905/78

[51] Int. Cl.[3] ..... B05B 1/08; B05B 3/14; B05B 17/06

[52] U.S. Cl. ..... 239/102; 239/453; 239/533.9

[58] Field of Search ..... 239/102, 453, 533.2–533.12, 239/571, 585; 261/1, DIG. 48

[56] References Cited

U.S. PATENT DOCUMENTS

| | | | |
|---|---|---|---|
| 3,039,699 | 6/1962 | Allen | 239/453 |
| 3,091,405 | 5/1963 | Knapp et al. | 239/453 |
| 3,542,293 | 11/1970 | Bishop et al. | 239/453 |
| 4,000,852 | 1/1977 | Martin | 239/102 |
| 4,013,223 | 3/1977 | Martin | 239/102 |
| 4,033,507 | 7/1977 | Frömel et al. | 239/102 |
| 4,040,569 | 8/1977 | Knapp | 239/585 |

FOREIGN PATENT DOCUMENTS

| | | | |
|---|---|---|---|
| 171080 | 10/1951 | Austria | 239/533.7 |

*Primary Examiner*—Robert W. Saifer
*Attorney, Agent, or Firm*—Fleit & Jacobson

[57] ABSTRACT

A low pressure fuel injection system for an engine, which system comprises an injector having a body, a fuel passage in the body, an outlet orifice, a valve obturator element, a spring which causes the valve obturator element to close the outlet orifice on its downstream side, and vibrator means for vibrating the injector to move the valve obturator element away from the outlet orifice to enable the fuel to pass through the outlet orifice.

5 Claims, 6 Drawing Figures

LOW PRESSURE FUEL INJECTION SYSTEM

This is a continuation of application Ser. No. 001,859 filed Jan. 8, 1979 now abandoned.

This invention relates to a low pressure fuel injection system for an engine.

High pressure fuel injection systems for engines are well known. One such high pressure fuel injection system which is currently produced by The Plessey Company Limited comprises an injector having a body, a fuel passage in the body, an outlet orifice, a valve obturator element which is caused by the pressure of fuel in the fuel passage to close the outlet orifice on its upstream side, vibrator means for vibrating the injector to move the valve obturator element away from the outlet orifice to enable fuel to pass through the outlet orifice, and a housing which is positioned around valve obturator element and which has a rear wall which is effective to limit the rearwards travel of the valve obturator element when the injector is being vibrated. This particular injector has been produced after much research and it preferably operates at a pressure of between 39 p.s.i. and 100 p.s.i., its optimum operational fuel pressure being approximately 65 p.s.i.

In the above mentioned high pressure fuel injection system, it will be apparent that a high pressure fuel pump is required to pump fuel to the injector. There is a current trend in the automotive industry to reduce the operating pressure of fuel injection systems to a low level, for example down to approximately 13 p.s.i., in order to enable low pressure fuel pumps to be used and therefore a cost saving to be achieved since low pressure fuel pumps are less expensive to manufacture than high pressure fuel pumps.

Now the above mentioned high pressure fuel injection system operates such that as the fuel pressure is reduced, so the stiffness of the fuel acting on the valve obturator element at the tip of the injector is reduced. Also, the closing bias on the valve obturator element created by the static fuel pressure is reduced. The resultant effect is a slowing down of the closing speed of the valve obturator element at the end of an electrical pulse causing the vibration. Thus, when the high pressure fuel injection system is worked at a low pressure, for example, at approximately 13 p.s.i., the injector operates in a very erratic manner. The reason for this is that the frequency of the valve obturator element vibrating within the cavity in the housing is greatly reduced and it also becomes less controlled. The very nature of the injector employed in the high pressure fuel injection system is such that at near zero fuel pressures it will not operate.

More specifically, in the above mentioned high pressure fuel system, the balance of forces on the valve obturator element is such that the opening force initially applied to the valve obturator element is produced by the ultrasonic vibrations of the seat on which the valve obturator element sits, this seat moving the valve obturator element away from it. Once the valve obturator element is off its seat and fuel is flowing between the valve seat and the valve obturator element, a favorable pressure differential is generated which further lifts the valve obturator element away from the seat, thereby increasing the flow rate. As the valve obturator element approaches the rear wall of the housing, the static fuel pressure comes to bear on the valve obturator element and this static fuel pressure plus the bouncing of the valve obturator element from the rear surface of the housing assists the valve obturator element to return back to its seat. On striking its seat, if there are no vibrations present, then the fuel pressure will hold the valve obturator element closed on its seat. If the seat is still vibrating then the valve obturator element will go through another cycle. In the absence of the required high fuel pressure, the valve obturator element will not quickly approach the seat and the fuel pressure may not be sufficient to hold the valve obturator element on the seat if there are no vibrations present.

In order for the valve obturator element to meter accurately and repeatedly from one pulse to the next, it is essential that the frequency at which the valve obturator element oscillates and also its movement within the ball cavity, is predictable.

It is an aim of the present invention to provide a vibrator-controlled low-pressure fuel injection system which will operate reliably when fuel is supplied at a pressure substantially below the minimum required for reliable operation of the above-described system.

Accordingly, this invention provides a low pressure fuel injection system for an engine, which system comprises an injector having a body, a fuel passage in the body, an outlet orifice, a valve obturator element, a spring which causes the valve obturator elment to close the outlet orifice on its downstream side, and vibrator means for vibrating the injector to move the valve obturator element away from the outlet orifice to enable the fuel to pass through the outlet orifice.

The low pressure fuel injection system of the invention can operate at low pressures of, for example, 39 p.s.i. down to near zero p.s.i. In this low pressure fuel injection system, the valve obturator element operates under the influence of a completely different set of forces to those acting on the valve obturator element in the high pressure fuel injection system. In the low pressure fuel injection system, the main forces acting on the valve obturator element are firstly the pre-load of the spring which holds the valve obturator element closed on its seat against the static fuel pressure. Once the injector is vibrated, then the seat vibrations impinging on the valve obturator element knock the valve obturator element from its seat against the pressure of the spring. Once this has happened, the pressure drop across the valve obturator element is gradually reduced as the valve obturator element moves away from its seat. However, as this force reduces, so the momentum forces of the fuel jet emerging from the outlet orifice increase and these momentum forces continue to increase up to a point where the spring compression force balances the jet momentum forces. Because of the dynamics of the low pressure fuel injection system there is an overrun situation set up where the momentum of the valve obturator element and the fuel jet carry the valve obturator element through the balance point so that the spring loading is increased above the momentum forces of the fuel. The spring then asserts itself and reverses the movement of the valve obturator element and returns it towards its seat. There is then sufficient momentum in the valve obturator element and the moving spring to carry the valve obturator element through the fuel jet until it again impinges on its seat. If the seat is still vibrating, the valve obturator element will again be knocked off its seat and will carry through another cycle. If however the vibrations have ceased, the valve obturator element will remain on its seat and will be held in this position by the static spring pre-load.

Preferably, the spring is fixed inside the tip of the injector.

The low pressure fuel injection system preferably includes guide means for guiding the valve obturator element back to its position against the outlet orifice. The guide means may be formed as an extension of the injector body past the outlet orifice. Alternatively, the guide means may be formed on the valve obturator element.

In the low pressure fuel injection system of the invention, the valve obturator element should be so designed that its vibrating frequency is sufficiently high to achieve at least some number of cycles during the minimum pulse expected to be used for the injector. This frequency is a function of the spring mass, the valve obturator element mass, the spring stiffness and the fuel jet effect. The basic equation for the frequency of the simple spring system is that the frequency is equal to $$\frac{1}{2X}\sqrt{\frac{S}{Mb + \frac{1}{3} Ms}}$$

where S is the spring stiffness, Mb is the valve obturator element mass and Ms is the spring mass.

The simple equation for the effect of the fuel jet on the valve obturator element is that the fuel jet force is equal to $\rho$ QU, where $\rho$ is the fuel density, Q is the volumetric flow rate and U is the jet velocity. This force is of course modified due to the fact that the fuel jet is continuously breaking up and diverging in its passage through the outlet orifice.

Preferably, the valve obturator element has a mass of 0.01 g to 0.25 g, and it has an equivalent volume diameter of from 2 to 4 mm, and in this case the spring preferably has a spring stiffness of 20 g per mm for a valve mass of 0.01 g to a spring stiffness of 240 g per mm for a valve mass of 0.25 g.

The invention will now be further illustrated with reference to the accompanying drawings in which.

Figure 1:
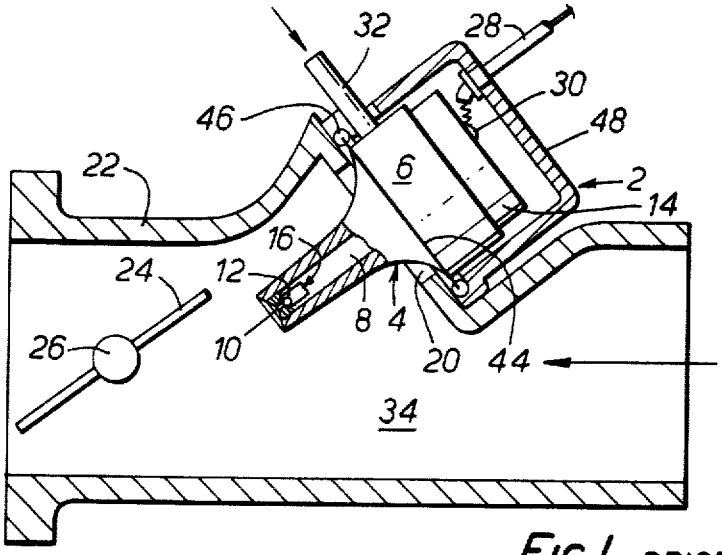
FIG. 1. PRIOR ART
FIG. 1 shows a prior-art high-pressure fuel injection system for an engine.
Figure 2:
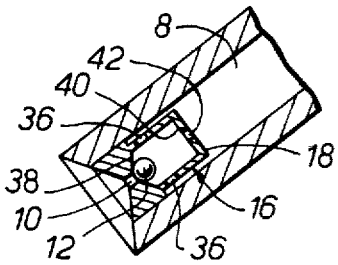
FIG. 2. PRIOR ART
FIG. 2 is an enlarged view of the injector tip shown in FIG. 1.

Referring to FIGS. 1 and 2, there is shown a fuel injection system 2 for an engine (not shown). The high-pressure fuel injection system 2 comprises an injector 4 having a body 6, a fuel passage 8 in the body 6, an outlet orifice 10, a ball valve obturator element 12 which is caused by the pressure of fuel in the fuel passage 8 to close the outlet orifice 10 on its upstream side, vibrator means in the form of a piezoelectric crystal 14 for vibrating the injector 4 to move the element 12 away from the outlet orifice 10 to enable fuel to pass through the outlet orifice 10, and a housing 16 which is positioned around the element 12 and which has a rear wall 18 which is effective to limit the rearwards travel of the element 12 when the injector 4 is being vibrated.

As shown in FIG. 1, the injector 4 protrudes through an opening 20 in an inlet manifold 22 for leading to the engine. The inlet manifold 22 is provided with a butterfly 24 which pivots about a pivot 26.

The nozzle 4 is vibrated by means of an electric current applied through a lead 28 to the piezoelectric crystal 14, the lead being soldered or otherwise secured to the piezoelectric crystal 14 at 30. Fuel is introduced to the fuel passage 8 through a fuel inlet pipe 32 and when the nozzle 4 is vibrating, an atomized fuel spray is injected into the duct 34 of the inlet manifold. More specifically, the fuel passing along the fuel passage 8 enters the inside of the housing 16 through a plurality of radial swirl slots 36 which are formed in the housing 16 and which can best be seen in FIG. 2. As the injector 4 is vibrated, the valve seat 38 is caused to vibrate and it is preferably arranged at an anti-node of the vibrations. The vibrating valve seat 38 causes the element 12 to be knocked away from the orifice 10 and then fuel in the housing 16 gets between the ball valve element 12 and the seat 38 and further assists in the rearward travel of the element 12. At the limit of its travel, the element 12 strikes the rear face 40 of the wall 18 and this rear face 40 gives the element 12 a force in the return direction. Any tendency for the element 12 to stick on the rear face 40 is further reduced by means of an aperture 42 which enables fuel to enter the housing 16 at the point where the element 12 might possibly stick and therefore to assist in forcing the element 12 away from the rear face 40. The element 12 thus returns to its seat 38 and if the seat 38 is not being vibrated then the element 12 will stay in its position and will close the outlet orifice 10. If the valve seat 38 is still being vibrated, then the element 12 will go through another cycle.

In order to assist in achieving a good vibration of the injector 4 and to minimize loss of vibrational energy to the manifold 22, it will be noted from FIG. 1 that the injector body 6 is provided with an outwardly extending flange 44 which engages a rubber O-ring. The injector can be maintained in a cover 48 and the O-ring 46 will substantially isolate the injector 4 from the cover 48 and therefore the manifold 22 and this will be effective to minimize loss of vibrational energy to the manifold 22.

Figure 3:
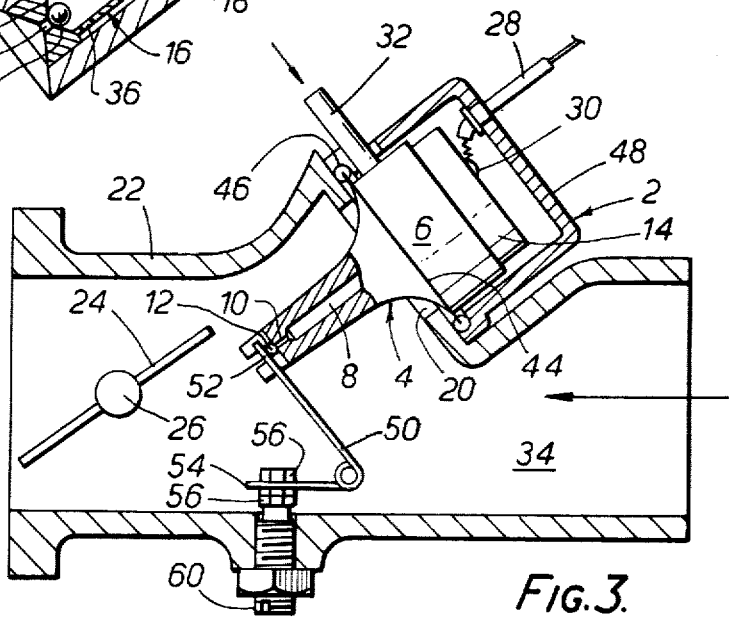
FIG. 3 shows a low pressure fuel injection system for an engine in accordance with the invention.
Figure 5:
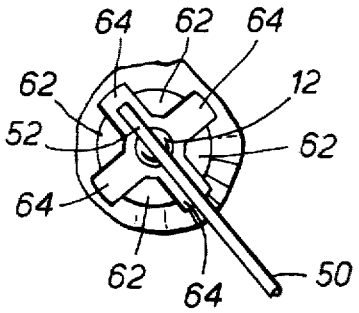
FIG. 5 is an end view of the injector tip as shown in FIG. 4.
Figure 4:
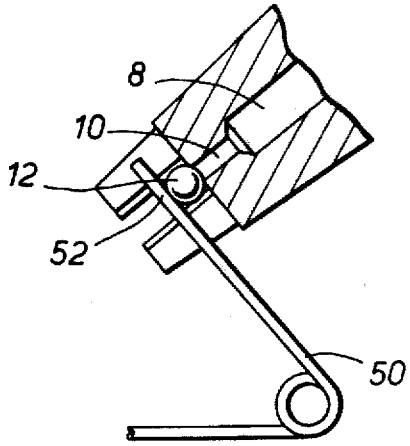
FIG. 4 is an enlarged detail of the injector tip shown in FIG. 3.

Referring now to FIGS. 3, 4 and 5, there is shown a fuel injection system which is similar except that the fuel injection system shown in FIGS. 3, 4 and 5 is a low pressure fuel injection system and the ball valve obturator element 12 is positioned downstream of the outlet orifice 10. In order to avoid undue repetition of description, similar parts have been given the same reference numeral and their construction and operation will not again be given.

As shown in FIGS. 3, 4 and 5, the element 12 is positioned downstream of the outlet orifice 10. The element 12 is held in this position by means of a spring 50, one end portion 52 of which rests on the element 12 or can be secured to the ball valve element 12. The other end portion 54 of the spring 50 is secured by nuts 56 to a threaded bolt 60 which can be screwed into and out of the manifold 22 to adjust the spring pre-load.

The element 12 is guided towards and away from the outlet orifice 10 by means of guides or extensions 62 to the nozzle tip as shown most clearly in FIG. 5. These guides 62 form slots 64 from which the fuel that has passed through the outlet orifice 10 can escape.

Figure 6:
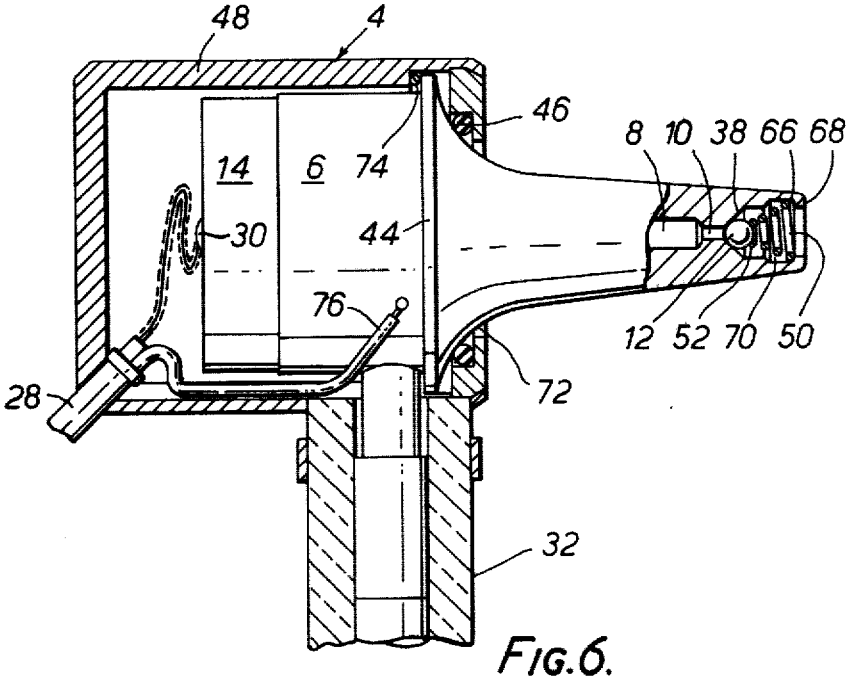
FIG. 6 is a section through a modified injector.

Referring now to FIG. 6, there is shown a modified injector 4 in accordance with the invention. In the injector 4 shown in FIG. 6, similar parts as in FIGS. 1 to 5 have been given the same reference numeral and their construction and operation will not again be given.

In FIG. 6, the spring 50 is a coil spring and its end remote from the ball valve element 12 abuts against a shoulder 66 formed in the injector tip 68. It will be seen from FIG. 6 that the spring 50 is housed in a recess 70 formed in the injector tip 68.

Also in FIG. 6, the curved part 72 of the injector 4 engages the O-ring 46, and a spring retainer member 74 secures the curved part 72 against the O-ring 46. An earth lead 76 is also shown in FIG. 6.

It is to be appreciated that the embodiments of the invention described above with reference to FIGS. 3 to 6 can be modified. Thus, for example, other types of spring 50 can be employed. Also, if desired, a different type of spring pre-load adjusting device than that illustrated as the adjustable bolt 60 in FIG. 3 could be employed. Further, the coil spring 50 shown in FIG. 6 could be positioned around the outside of the injector tip 68, and it could be positioned around the outside of the injector 4 illustrated in FIGS. 3 to 5 in which case the guides 62 may be dispensed with.

What we claim is:

1. A low-pressure fuel-injection system for the injection fuel at a pressure less than 39 p.s.i. into the intake air of a combustion engine, which system comprises an injector having a body; a fuel passage in the body; an outlet orifice arranged at a downstream end of said fuel passage for discharging the fuel into such intake air; a single valve obturator element, said single obturator element being positioned at the downstream end of said outlet orifice for closing said orifice; a spring positioned downstream of said outlet orifice for urging the single valve obturator element to close the outlet orifice on its downstream side, said spring being sufficiently strong to hold said obturator in an orifice-closing position against the force exerted upon it by such low-pressure fuel in said orifice; and vibrator means for vibrating the injector to overcome the spring force and thereby move the single valve obturator element away from the outlet orifice to enable fuel to be discharged through the outlet orifice.

2. A low pressure fuel injection system according to claim 1 wherein the injector has a tip downstream of said orifice, and wherein the spring is fixed inside the tip of the injector.

3. A low pressure fuel injection system according to claim 1 or claim 2 including guide means for guiding the valve obturator element back to its position against the outlet orifice.

4. A low pressure fuel injection system according to claim 1 or claim 2 in which the valve obturator element has a mass of 0.01 g to 0.25 g, and in which it has an equivalent volume diameter of from 2 to 4 mm.

5. A low pressure fuel injection system according to claim 4 in which the spring has a spring stiffness of 20 g per mm for a valve mass of 0.01 g to a spring stiffness of 240 g per mm for a valve mass of 0.25 g.

* * * * *